US010209672B2

(12) United States Patent
Takahashi

(10) Patent No.: US 10,209,672 B2
(45) Date of Patent: Feb. 19, 2019

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kazutoshi Takahashi, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/021,097

(22) Filed: Jun. 28, 2018

(65) Prior Publication Data

US 2018/0321638 A1 Nov. 8, 2018

Related U.S. Application Data

(63) Continuation of application No. 15/678,395, filed on Aug. 16, 2017, which is a continuation-in-part of application No. 15/344,678, filed on Nov. 7, 2016.

(51) Int. Cl.

| | |
|---|---|
| ***G03G 21/20*** | (2006.01) |
| ***G03G 15/01*** | (2006.01) |
| ***G03G 15/20*** | (2006.01) |
| *G03G 15/00* | (2006.01) |

(52) U.S. Cl.

CPC ..... *G03G 21/206* (2013.01); *G03G 15/0126* (2013.01); *G03G 15/2017* (2013.01); *G03G 15/2039* (2013.01); *G03G 15/6582* (2013.01)

(58) Field of Classification Search

CPC ..... G03G 15/2017; G03G 15/2039; G03G 15/0216; G03G 15/6582; G03G 21/206

See application file for complete search history.

(56) References Cited

U.S. PATENT DOCUMENTS

| | | | |
|---|---|---|---|
| 5,459,562 | A | 10/1995 | Mitsuya et al. |
| 5,550,621 | A | 8/1996 | Ogawahara |
| 5,835,830 | A | 11/1998 | Fukuda et al. |
| 6,021,290 | A | 2/2000 | Hamada et al. |

(Continued)

FOREIGN PATENT DOCUMENTS

| | | |
|---|---|---|
| JP | 2015-099188 | 5/2015 |

OTHER PUBLICATIONS

Non-Final Office Action for U.S. Appl. No. 15/344,678 dated Jan. 10, 2018.

(Continued)

*Primary Examiner* — David Bolduc

(74) *Attorney, Agent, or Firm* — Amin, Turocy & Watson LLP

(57) ABSTRACT

An image forming apparatus according to an embodiment includes an image forming unit, a heating unit, a fan, a guide, and a control unit. The image forming unit forms an image on a recording medium. The heating unit is disposed on a downstream side of the image forming unit in a transport direction of the recording medium. The heating unit is driven with at least two temperatures, a first temperature and a second temperature lower than the first temperature. The fan generates wind. The guide guides the wind generated from the fan to the heating unit. The control unit controls the fan and the guide when the control unit controls the heating unit by switching between driving the heating unit at the first temperature and at the second temperature.

40 Claims, 10 Drawing Sheets

(56) References Cited

U.S. PATENT DOCUMENTS

| | | | |
|---|---|---|---|
| 6,058,287 | A | 5/2000 | Haneda et al. |
| 6,374,063 | B1 | 4/2002 | Todome |
| 6,889,012 | B2 | 5/2005 | Morimoto |
| 7,194,221 | B2 | 3/2007 | Kim et al. |
| 8,005,393 | B2 | 8/2011 | Satomi |
| 8,380,114 | B2 | 2/2013 | Watanabe |
| 8,521,076 | B2 | 8/2013 | Masuda |
| 8,554,099 | B2 | 10/2013 | Kitagawa |
| 8,755,706 | B2 | 6/2014 | Minagawa et al. |
| 8,855,516 | B2 | 10/2014 | Koyama et al. |
| 8,909,088 | B2 | 12/2014 | Murooka |
| 9,104,154 | B2 | 8/2015 | Fujiwara |
| 9,116,480 | B2 | 8/2015 | Kadawaki et al. |
| 9,411,274 | B2 | 8/2016 | Kadawaki et al. |
| 9,452,629 | B1 | 9/2016 | Ishii |
| 2005/0078976 | A1 | 4/2005 | Deguchi et al. |
| 2005/0111864 | A1 | 5/2005 | Yamaguchi |
| 2005/0220477 | A1 | 10/2005 | Nakane |
| 2005/0238379 | A1 | 10/2005 | Ogane et al. |
| 2006/0051124 | A1 | 3/2006 | Oka |
| 2006/0133865 | A1 | 6/2006 | Nakamura et al. |
| 2006/0284960 | A1 | 12/2006 | Kishi |
| 2007/0059001 | A1 | 3/2007 | Matsuura et al. |
| 2007/0059012 | A1 | 3/2007 | Tomine et al. |
| 2007/0059021 | A1 | 3/2007 | Hanashi et al. |
| 2007/0059022 | A1 | 3/2007 | Yamaoka et al. |
| 2007/0059023 | A1 | 3/2007 | Koshida |
| 2007/0059024 | A1 | 3/2007 | Kitayama |
| 2007/0071485 | A1 | 3/2007 | Yuasa |
| 2007/0212104 | A1 | 9/2007 | Miyamoto et al. |
| 2007/0217841 | A1 | 9/2007 | Fujii |
| 2007/0280721 | A1 | 12/2007 | Kanai |
| 2008/0031669 | A1 | 2/2008 | Takei |
| 2008/0050144 | A1 | 2/2008 | Hashimoto |
| 2009/0016764 | A1 | 1/2009 | Kitozaki |
| 2009/0154970 | A1 | 6/2009 | Yoshida et al. |
| 2009/0190981 | A1 | 7/2009 | Tanaka |
| 2010/0189476 | A1 | 7/2010 | Tanaka et al. |
| 2010/0272449 | A1 | 10/2010 | Yoshida et al. |
| 2010/0290812 | A1 | 11/2010 | Taguchi et al. |
| 2011/0142486 | A1 | 6/2011 | Komiyama et al. |
| 2011/0211860 | A1 | 9/2011 | Shimoyama et al. |
| 2011/0262197 | A1 | 10/2011 | Imamiya et al. |
| 2012/0002997 | A1 | 1/2012 | Hiraoka et al. |
| 2012/0070179 | A1 | 3/2012 | Mizuno et al. |
| 2012/0121286 | A1 | 5/2012 | Suzuki |
| 2012/0201564 | A1 | 8/2012 | Masuda |
| 2012/0301174 | A1 | 11/2012 | Masuda |
| 2012/0328323 | A1 | 12/2012 | Murooka |
| 2013/0011157 | A1 | 1/2013 | Kaino et al. |
| 2013/0094877 | A1 | 4/2013 | Tsuji et al. |
| 2013/0236202 | A1 | 9/2013 | Akiya |
| 2013/0251385 | A1 | 9/2013 | Mitourida |
| 2013/0272739 | A1 | 10/2013 | Otaki |
| 2014/0105627 | A1 | 4/2014 | Fujiwara |
| 2014/0161481 | A1 | 6/2014 | Udagawa |
| 2014/0193168 | A1 | 7/2014 | Kimoto |
| 2014/0286665 | A1 | 9/2014 | Minagawa et al. |
| 2014/0376950 | A1 | 12/2014 | Hara et al. |
| 2015/0241823 | A1 | 8/2015 | Fukai |
| 2015/0309454 | A1 | 10/2015 | Kadowaki et al. |
| 2016/0154359 | A1 | 6/2016 | Watanabe et al. |
| 2017/0060049 | A1 | 3/2017 | Hasegawa |

OTHER PUBLICATIONS

Non-Final Office Action for U.S. Appl. No. 15/678,395 dated Apr. 5, 2018.

IMAGE FORMING APPARATUS

CROSS-REFERENCE TO RELATED APPLICATIONS

This application is a Continuation of U.S. non-Provisional patent application Ser. No. 15/678,395, filed on Aug. 16, 2017; which is a Continuation-in-Part of U.S. non-Provisional patent application Ser. No. 15/344,678, filed on Nov. 7, 2016; the entire contents of both of which are incorporated herein by reference.

FIELD

Embodiments described herein relate generally to an image forming apparatus and methods associated therewith.

BACKGROUND

In the related art, there are image forming apparatuses such as multi function peripherals (hereinafter referred to as "MFPs") and printers. An image forming apparatus includes a fixing device. The fixing device includes a heating roller and a belt. The belt is suspended on a plurality of rollers. The fixing device forms a nip between the heating roller and the belt. The fixing device fixes a toner image on a recording medium by heat of the heating roller. The fixing device is controlled in a fixing mode and a decolorizing mode. In the fixing mode, a toner image is fixed to a recording medium. In the decolorizing mode, a toner image is decolorized from the recording medium. In the decolorizing mode, the temperature of the heating roller is set to be higher than in the fixing mode. For example, when the fixing mode is switched to the decolorizing mode, the heating roller is heated. Conversely, when the decolorizing mode is switched to the fixing mode, the heating roller performs idle running for natural cooling. However, with only the idle running of the heating roller, it may take an undesirably long time to sufficiently cool the heating roller. Therefore, there is a possibility that a time in which a user may not use the image forming apparatus occurs.

DETAILED DESCRIPTION

Figure 1:
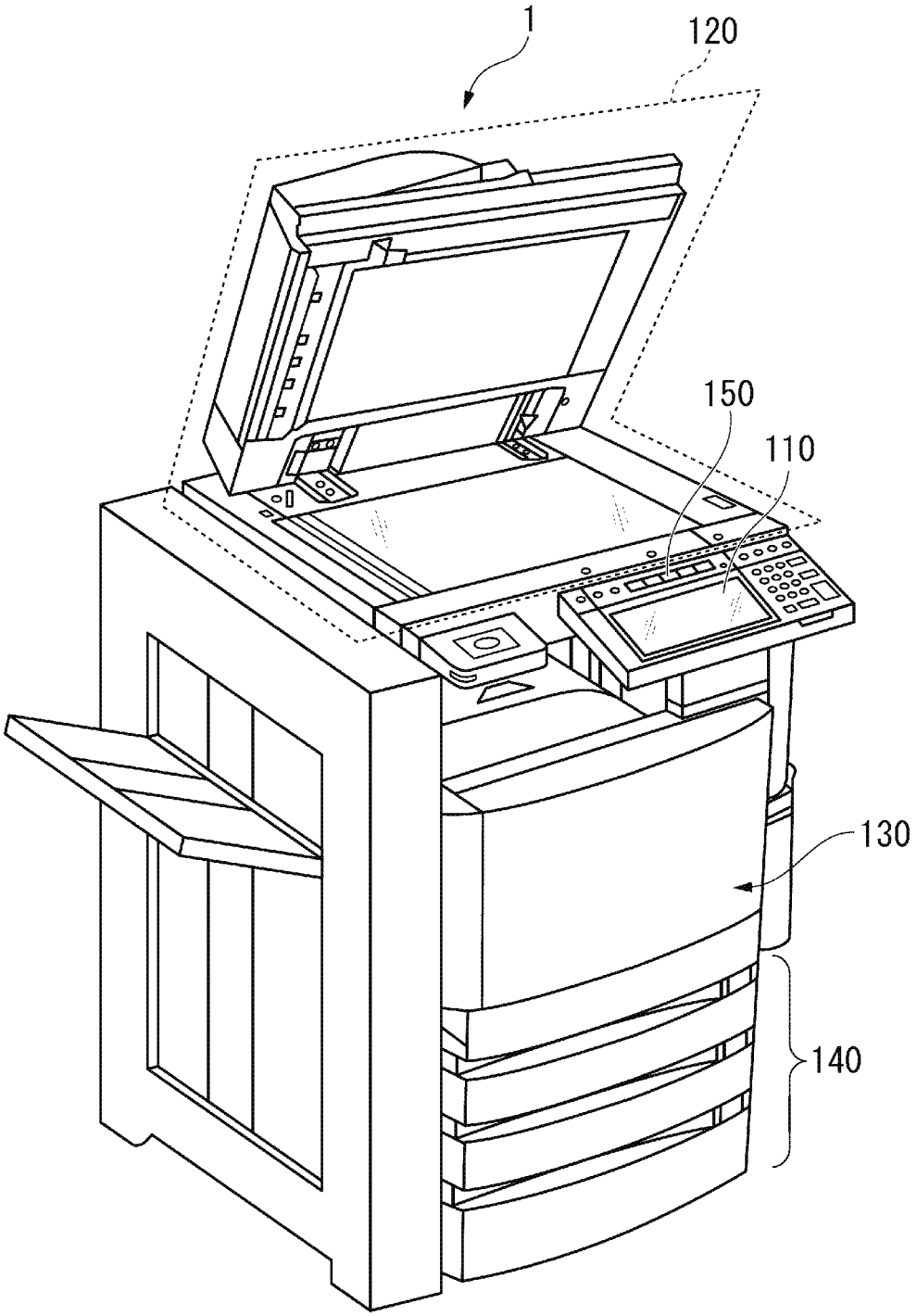
FIG. 1 is an external view illustrating an example of an image forming apparatus according to an embodiment.

An image forming apparatus according to an embodiment includes an image forming unit, a heating unit, a fan, a guide, and a control unit. The image forming unit forms an image on a recording medium. The heating unit is disposed on a downstream side of the image forming unit in a transport direction of the recording medium. The heating unit is driven with at least two temperatures, a first temperature and a second temperature lower than the first temperature. The fan generates wind. The guide guides the wind generated from the fan guides to the heating unit. The control unit controls the fan and the guide when the control unit controls the heating unit by switching between driving the heating unit at the first temperature and at the second temperature.

Hereinafter, an image forming apparatus 1 according to an embodiment will be described with reference to the drawings. The same reference numerals are given to the same configurations throughout the drawings.

FIG. 1 is an external view illustrating an example of the image forming apparatus 1 according to an embodiment. For example, the image forming apparatus 1 is a multi function peripheral (MFP). The image forming apparatus 1 reads an image formed on a sheet-shaped recording medium (hereinafter referred to as a "sheet") such as paper and generates digital data (image file). The image forming apparatus 1 forms the image on the sheet using toner based on the digital data.

The image forming apparatus 1 includes a display unit 110, an image reading unit 120, an image forming unit 130, and a sheet tray 140.

The display unit 110 operates as an output interface and displays text or an image. The display unit 110 also operates an input interface and receives an instruction from a user. For example, the display unit 110 is a touch panel type liquid crystal display.

For example, the image reading unit 120 is a color scanner. As the color scanner, there is a contact image sensor (CIS) or a charge coupled device (CCD). The image reading unit 120 reads an image formed on the sheet using a sensor and generates digital data.

The image forming unit 130 forms an image on a sheet using toner. The image forming unit 130 forms an image based on image data read from the image reading unit 120 or an image based on image data received from an external apparatus. For example, the image formed on the sheet is an output image called a hard copy or a printout.

The sheet tray 140 supplies a sheet to be used for image output to the image forming unit 130.

Figure 2:
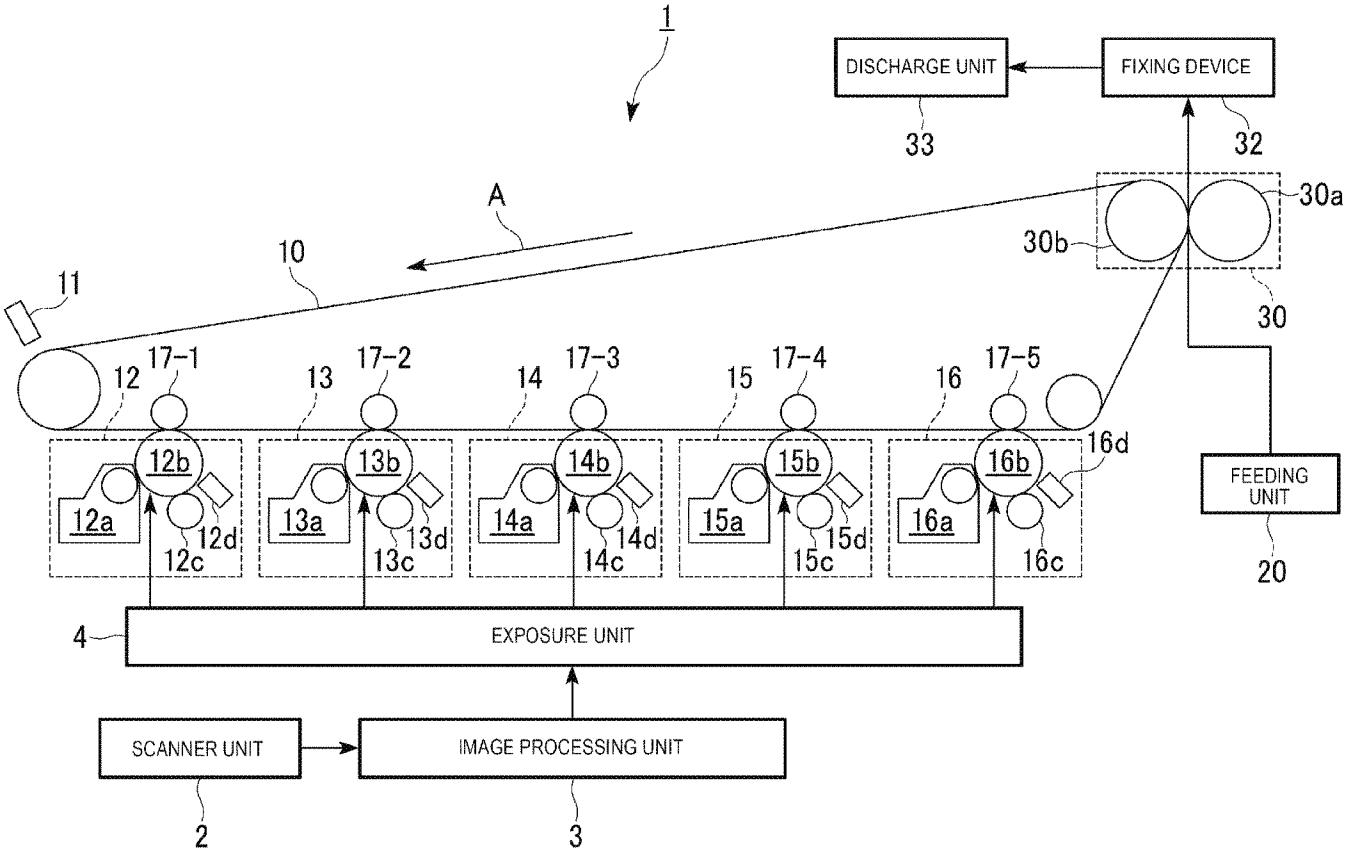
FIG. 2 is a diagram illustrating an example of a schematic configuration of the image forming apparatus according to the embodiment.

FIG. 2 is a diagram illustrating an example of a schematic configuration of the image forming apparatus 1 according to the embodiment. The image forming apparatus 1 is an electrographic image forming apparatus. The image forming apparatus 1 is a 5-randem type image forming apparatus.

Examples of toner include decolorable toner, non-decolorable toner (normal toner), and decorative toner. The decolorable toner has a decolorizing property in accordance with external stimuli. The "decolorizing" means that an image formed with a color (including not only a chromatic color but also an achromatic color such as white and black) different from a ground color of a sheet is visually unseen. For example, external stimuli are temperature, light with a specific wavelength, and pressure. In the embodiment, decolorable toner realizes decolorizing when a temperature reaches a specific decolorable temperature or more. The decolorable toner realizes colorizing when temperature reaches a specific restoring temperature or less after decolorizing.

Any decolorable toner may be used as long as the decolorable toner has the above-described property. For example, a coloring material of the decolorable toner may be leuco dye. The decolorable toner may be toner in which a developer, a decolorizer, a decoloration-temperature regulator, and the like may be appropriately combined.

The fixing temperature of the decolorable toner is lower than the fixing temperature of non-decolorable toner. Here, the fixing temperature of the decolorable toner means the temperature of the heating roller 40 in a decolorable toner mode to be described below. The fixing temperature of the non-decolorable toner means the temperature of the heating roller 40 in a monochromatic toner mode or a colorable toner mode to be described below.

The the the colora of the decolorable toner is lower than the temperature of a decolorizing process of the decolorable toner. Here, the temperature of a decolorizing process for the decolorable toner means the temperature of the heating roller 40 in a decolorizing mode to be described below.

The image forming apparatus 1 includes a scanner unit 2, an image processing unit 3, an exposure unit 4, an intermediate transfer body 10, a cleaning blade 11, image generation units 12 to 16, primary transfer rollers 17-1 to 17-5, a feeding unit 20, a secondary transfer unit 30, a fixing device 32, and a discharge unit 33. Hereinafter, when the primary transfer rollers are not distinguished from each other, the primary transfer rollers are simply notated as the primary transfer rollers 17.

In the following description, since a sheet is transported from the feeding unit 20 to the discharge unit 33, the side of the feeding unit 20 is referred to as an upstream side in a sheet transport direction and the side of the discharge unit 33 is referred to as a downstream side in the sheet transport direction.

In transferring of the image forming apparatus 1, there are a primary transfer process and a secondary transfer process. In the primary transfer process, the primary transfer rollers 17 transfer images formed with toner on photoconductive drums of the image generation units to the intermediate transfer body 10. In the secondary transfer process, the secondary transfer unit 30 transfers images formed by the tone of respective colors stacked on the intermediate transfer body 10 to the sheet.

The scanner unit 2 reads an image formed on a sheet which is a scanning target. For example, the scanner unit 2 reads the image on the sheet and generates image data of the three primary colors of red (R), green (G), and blue (B). The scanner unit 2 outputs the generated image data to the image processing unit 3.

The image processing unit 3 converts the image data into color signals of the respective colors. For example, the image processing unit 3 converts the image data into image data (color signals) of four colors, yellow (Y), magenta (M), cyan (C), and black (K). The image processing unit 3 controls the exposure unit 4 based on the color signals of the respective colors.

The exposure unit 4 radiates (exposes) light to the photoconductive drums of the image generation units. The exposure unit 4 includes an exposure light source such as a laser or an LED.

The intermediate transfer body 10 is an endless belt. The intermediate transfer body 10 is rotated in the direction of an arrow A in FIG. 2. The images of the toner are formed on the surface of the intermediate transfer body 10.

The cleaning blade 11 removes the toner attached on the intermediate transfer body 10. For example, the cleaning blade 11 is a plate-shaped member. For example, the cleaning blade 11 is formed of a resin such as a urethane resin.

The image generation units 12 to 16 form the images using the toner of respective colors (5 colors in the example illustrated in FIG. 2). The image generation units 12 to 16 are installed in order along the intermediate transfer body 10.

The primary transfer rollers 17 (17-1 to 17-5) are used to transfer the images formed with the toner and formed by the image generation units 12 to 16 to the intermediate transfer body 10.

The feeding unit 20 feeds a sheet.

The secondary transfer unit 30 is one specific example of a secondary transfer body. The secondary transfer unit 30 includes a secondary transfer roller 30*a* and a secondary transfer counter roller 30*b*. The secondary transfer unit 30 transfers the images formed with the toner and formed on the intermediate transfer body 10 to the sheet.

The fixing device 32 fixes the images formed with the toner and transferred to the sheet by heating and pressurizing. The sheet on which the images are formed by the fixing device 32 is discharged from the discharge unit 33 to the outside of the apparatus.

Next, the image generation units 12 to 16 will be described. The image generation units 12 to 15 accommodate the toner of respective colors corresponding to 4 colors for color printing. The 4 colors for color printing are yellow (Y), magenta (M), cyan (C), and black (K). The toner of the 4 colors for color printing is non-decolorable toner. The image generation unit 16 accommodates decolorable toner. The image generation units 12 to 15 and the image generation unit 16 have the same configuration although the accommodated toner is different. Accordingly, the image generation unit 12 will be described as a representative of the image generation units 12 to 16. The other image generation units 13 to 16 will not be described.

The image generation unit 12 includes a developing unit 12*a*, a photoconductive drum 12*b*, a charging unit 12*c*, and a cleaning blade 12*d*.

The developing unit 12*a* accommodates a developer. The developer includes toner. The developing unit 12*a* attaches the toner to the photoconductive drum 12*b*.

The photoconductive drum 12*b* is one specific example of an image carrier (image carrying unit). The photoconductive drum 12*b* includes a photoreceptor (photoconductive region) on its circumferential surface. For example, the photoreceptor is an organic photoconductor (OPC).

The charging unit 12*c* uniformly charges the surface of the photoconductive drum 12*b*.

The cleaning blade 12*d* removes the toner attached onto the photoconductive drum 12*b*.

Next, an overview of an operation of the image generation unit 12 will be described.

The photoconductive drum 12*b* is charged with a predetermined potential by the charging unit 12*c*. Subsequently, light is radiated from the exposure unit 4 to the photoconductive drum 12*b*. Thus, in the photoconductive drum 12*b*, the potential of a region to which the light is radiated is changed. Through the change in the potential, an electrostatic latent image is formed on the surface of the photoconductive drum 12*b*. The electrostatic latent image on the surface of the photoconductive drum 12*b* is developed by the developer of the developing unit 12*a*. That is, an image developed by the toner (hereinafter referred to as a "developed image") on the surface of the photoconductive drum 12*b*.

The developed image formed on the surface of the photoconductive drum 12*b* is transferred onto the intermediate transfer body 10 by the primary transfer roller 17-1 facing the photoconductive drum 12*b* (the primary transfer process).

Next, the primary transfer process in the image forming apparatus 1 will be described. First, the primary transfer roller 17-1 facing the photoconductive drum 12*b* transfers the developed image on the photoconductive drum 12*b* to the intermediate transfer body 10. Subsequently, the primary transfer roller 17-2 facing the photoconductive drum 13*b* transfers the developed image on the photoconductive drum 13*b* to the intermediate transfer body 10. This process is also performed in the photoconductive drums 14*b*, 15*b*, and 16*b*. At this time, the developed images on the photoconductive drums 12*b* to 16*b* are transferred to the intermediate transfer body 10 so that the developed images overlap each other. Therefore, the developed images formed with the toner of the respective colors are transferred onto the intermediate transfer body 10 so that the developed images overlap after passing through the image generation unit 16.

Here, when an image is formed using only non-decolorable toner, the image generation units 12 to 15 operate. Through such operations, the developed images are formed using the non-decolorable toner on the intermediate transfer body 10. When an image is formed using only the decolorable toner, the image generation unit 16 operates. Through such an operation, the developed image is formed using only the decolorable toner on the intermediate transfer body 10.

Next, the secondary transfer process will be described. A voltage (bias) is applied to the secondary transfer counter roller 30*b*. Therefore, an electric field is generated between the secondary transfer counter roller 30*b* and the secondary transfer roller 30*a*. The secondary transfer unit 30 transfers the developed images formed on the intermediate transfer body 10 to a sheet by the electric field.

Figure 3:
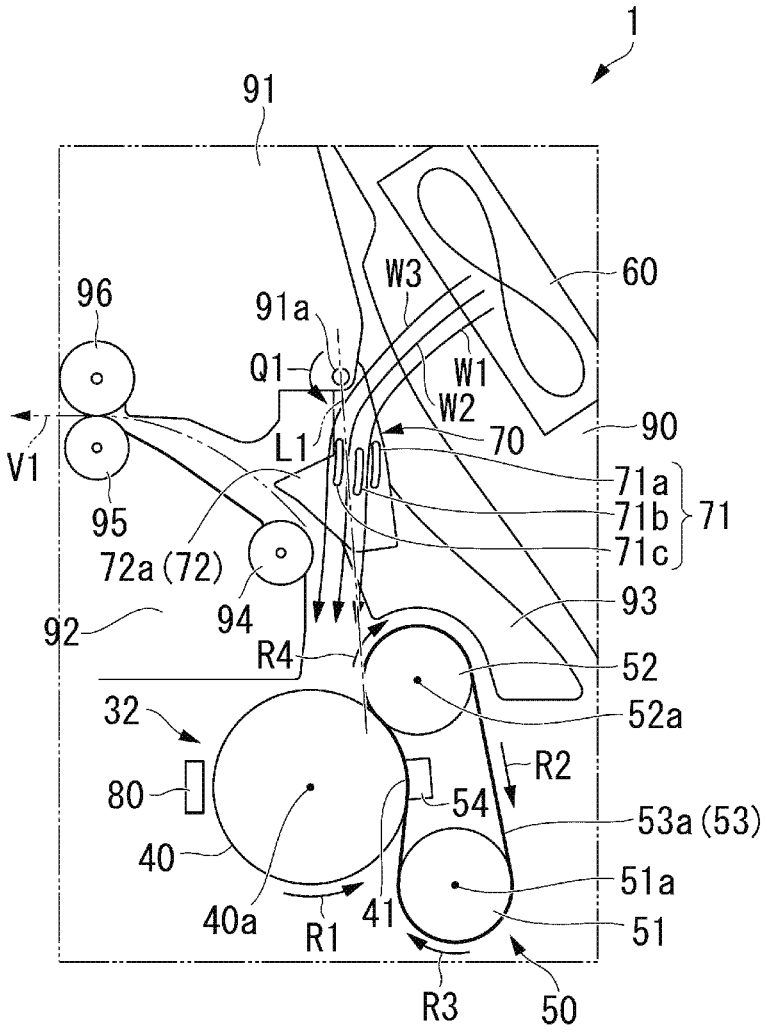
FIG. 3 is a diagram illustrating main units of the image forming apparatus according to the embodiment.

FIG. 3 is a diagram illustrating main units of the image forming apparatus 1 according to the embodiment.

Figure 6:
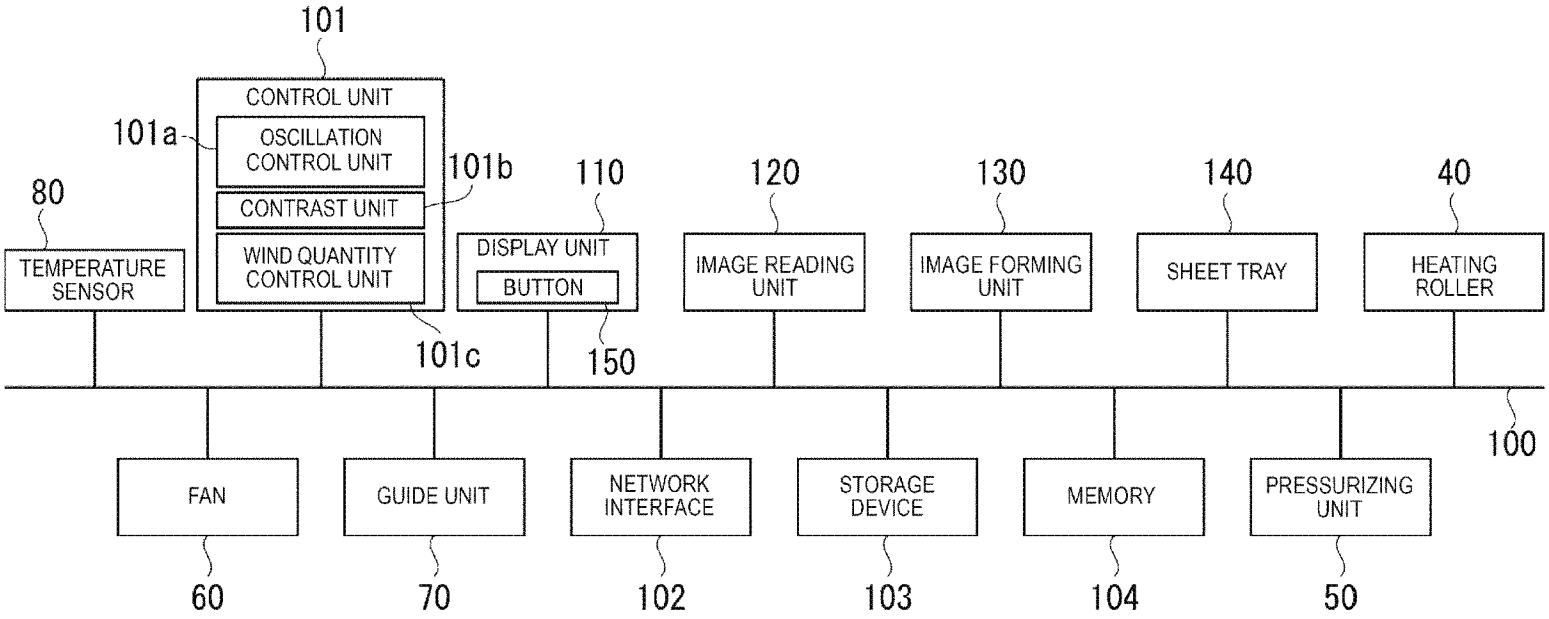
FIG. 6 is a block diagram illustrating an example of a functional configuration of the image forming apparatus according to the embodiment.

As illustrated in FIG. 3, the image forming apparatus 1 includes the fixing device 32, a fan 60, a guide unit 70, a temperature sensor 80, and a control unit 101 (see FIG. 6). Reference numerals 90, 91, 92, and 93 denote transport path forming units that forma transport path of a sheet. Reference numerals 94, 95, and 96 denote transport rollers that transport a sheet.

Hereinafter, the fixing device 32 will be described in detail.

As illustrated in FIG. 3, the fixing device 32 includes a heating roller 40 (heating unit) and a pressurizing unit 50.

First, the heating roller 40 which is a heating unit will be described.

The heating roller 40 is disposed on the downstream side of the image forming unit 130 in the sheet transport direction. The heating roller 40 is driven with two target temperatures to be described below. The heating roller 40 is an endless fixing member. The heating roller 40 has a curved outer circumferential surface. That is, the heating roller 40 has a cylindrical shape. The heating roller 40 includes a roller made of metal. For example, the heating roller 40 includes a resin layer such as fluorocarbon resin on the outer circumferential surface of a roller made of aluminum. The heating roller 40 is rotatable about a first axis 40*a*. Here, the first axis 40*a* means a central axis (rotational axis) of the heating roller 40.

The fixing device 32 further includes a heating source (not illustrated) that heats the heating roller 40. For example, the heating source may be a resistance heating body such as a thermal head, a ceramic heater, a halogen lamp, an electromagnetic induction heating unit. The position of the heating source may be disposed inside the heating roller 40 or may be disposed outside.

Next, the pressurizing unit 50 will be described.

The pressurizing unit 50 includes a plurality of rollers 51 and 52, a belt 53 (rotator), and a pressurizing pad 54 (pressurizing member).

The plurality of rollers 51 and 52 are disposed inside the belt 53. In the embodiment, the plurality of rollers 51 and 52 are configured as a first roller 51 and a second roller 52. The plurality of rollers 51 and 52 may be the same roller or may be different rollers.

The plurality of rollers 51 and 52 are rotatable about a plurality of rotational axes 51*a* and 52*a* parallel to the first axis 40*a*. The plurality of rollers 51 and 52 are disposed at positions contributing to formation of a nip 41.

The first roller 51 is disposed on the upstream side of the second roller 52 in the sheet transport direction. The first roller 51 is formed in a columnar shape. For example, the first roller 51 is a roller made of metal such as iron. The first roller 51 is rotatable about the first rotational axis 51*a* parallel to the first axis 40*a*. Here, the first rotational axis 51*a* means the central axis of the first roller 51.

The second roller 52 is disposed on the downstream side of the first roller 51 in the sheet transport direction. The second roller 52 is formed in a columnar shape. For example, the second roller 52 is a roller made of metal such as iron. The second roller 52 is rotatable about the second rotational axis 52*a* parallel to the first axis 40*a*. Here, the second rotational axis 52*a* means the central axis of the second roller 52.

The belt 53 faces the heating roller 40. The belt 53 is suspended on the first roller 51 and the second roller 52. The belt 53 is formed in the endless shape.

The belt 53 includes a base layer 53*a* and a release layer (not illustrated). For example, the base layer 53*a* is formed of a polyimide resin (PI). For example, the release layer is formed of a fluorocarbon resin such as a tetrafluoroethylene-perfluoroalkylvinylether copolymer (PFA). The layer structure of the belt 53 is not limited. The belt 53 includes a film-shaped member.

The pressurizing pad 54 is formed in a rectangular parallelepiped shape. For example, the pressurizing pad 54 is formed of a resin material such as a polyphenylene sulfide (PPS), a liquid crystal polymer (LCP), or a phenol resin (PF) with heat resistance. The pressurizing pad 54 is disposed at a position facing the heating roller 40 with the belt 53 interposed therebetween. The pressurizing pad 54 is urged toward the heating roller 40 by an urging member (not illustrated) such as a spring. The pressurizing pad 54 comes into contact with the inner circumferential surface of the belt 53 and presses the belt 53 against the heating roller 40 to form the nip 41. That is, the pressurizing pad 54 presses the inner circumferential surface of the belt 53 to the side of the heating roller 40 to form the nip 41 between the belt 53 and the heating roller 40.

Hereinafter, a rotational direction of the heating roller 40 and the like will be described.

The heating roller 40 is rotated in the direction of an arrow R1 by a motor (not illustrated). That is, the heating roller 40 is rotated in the direction of the arrow R1 independently from the pressurizing unit 50.

The belt 53 follows the heating roller 40 to be rotated in the direction of an arrow R2. That is, the belt 53 comes into contact with the outer circumferential surface of the heating roller 40 rotated in the direction of the arrow R1 and follows to be rotated.

The first roller 51 follows the belt 53 to be rotated in the direction of an arrow R3. The second roller 52 follows the belt 53 to be rotated in the direction of an arrow R4. That is, the first roller 51 and the second roller 52 come into contact with the internal circumferential surface of the belt 53 rotated in the direction of the arrow R2 and follows to be rotated.

Next, the fan 60 will be described.

The fan 60 is disposed inside the image forming apparatus 1. The fan 60 generates wind. The fan 60 cools the fixing device 32 using the wind. The fan 60 is disposed on the downstream side of the fixing device 32 in the sheet transport direction. The fan 60 is installed in the transport path forming unit 90. The fan 60 sucks the outer air from an air inlet (not illustrated) and sends wind to the fixing device 32. For example, the fan 60 is a propeller fan (axial fan). The fan 60 may be a centrifugal fan such as a sirocco fan or a turbo fan.

Next, the guide unit 70 will be described.

The guide unit 70 is disposed on the downstream side of the fixing device 32 in the sheet transport direction. The guide unit 70 guides the wind generated from the fan 60 to the heating roller 40. Further, the guide unit 70 switches the transport path of a sheet. A spindle 91*a* parallel to the first axis 40*a* is installed in the transport path forming unit 91. The guide unit 70 is rotatable around the spindle 91*a*. Specifically, the guide unit 70 is rotated about the spindle 91*a* in the direction of an arrow Q1 to switch the transport path of a sheet in the direction of an arrow V1. Conversely, the guide unit 70 is rotated about the spindle 91*a* in the direction of an arrow Q2 (see FIG. 5) to switch the transport path of a sheet in the direction of an arrow V2 (see FIG. 5).

Figure 4:
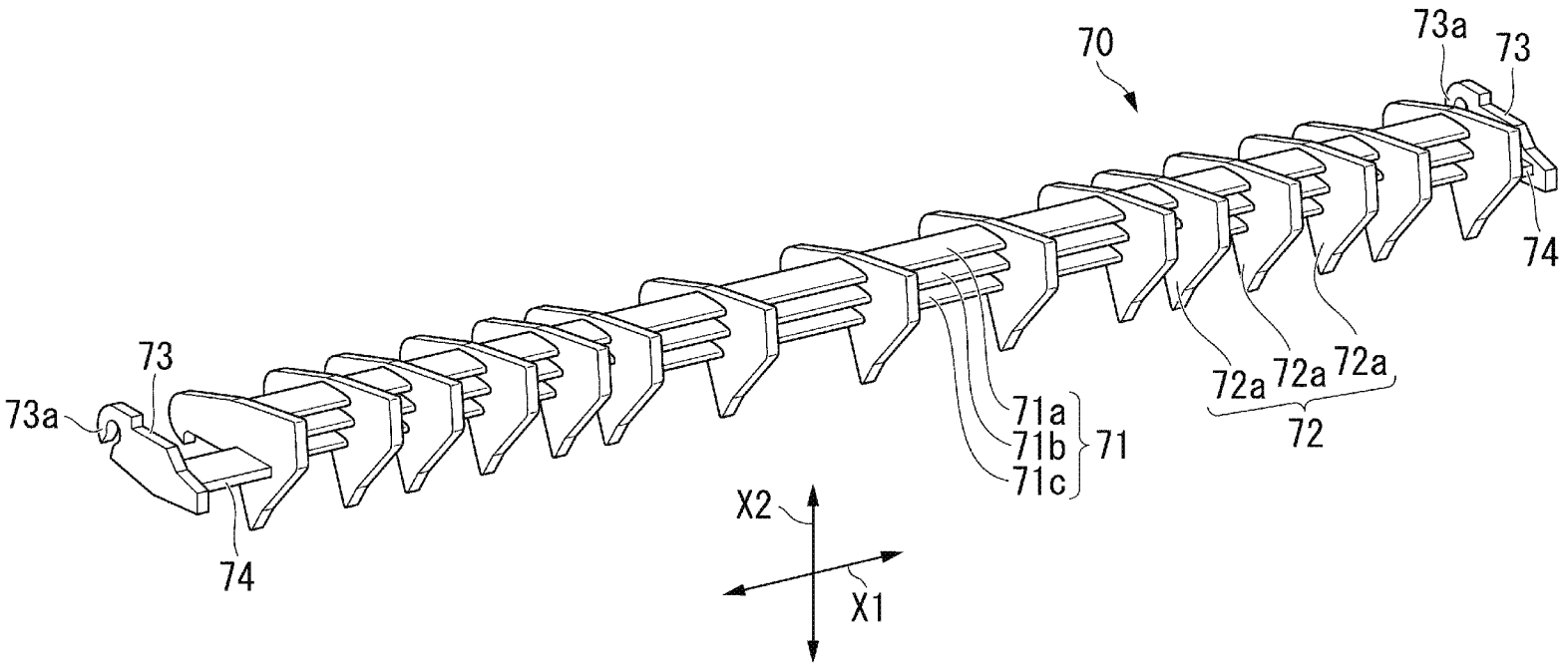
FIG. 4 is a perspective view illustrating a guide unit according to the embodiment.

FIG. 4 is a perspective view illustrating the guide unit 70 according to the embodiment.

As illustrated in FIG. 4, the guide unit 70 includes a guide 71, a switch member 72, locking members 73, and connection members 74. For example, the guide unit 70 is formed of a resin material. The guide 71, the switch member 72, the locking members 73, and the connection members 74 are formed to be integrated by the same member.

The guide 71 is disposed on the downstream side of the fixing device 32 in the sheet transport direction. The guide 71 guides the wind generated from the fan 60 to the heating roller 40. The guide 71 is formed to be integrated with the switch member 72.

The switch member 72 switches the transport path of a sheet. The switch member 72 includes a plurality of switch plates 72*a* (for example, 15 switch plates in the embodiment). The plurality of switch plates 72*a* are disposed at intervals in the first direction X1 intersecting the transport path. An interval of two mutually adjacent switch plates 72*a* is greater in the middle than on both sides in the first direction X1. The switch plates 72*a* have a V shape projecting toward the fixing device 32 when viewed in the first direction X1 (see FIG. 3). The plurality of switch plates 72*a* have substantially the same outer appearance.

The guide 71 is joined to the plurality of switch plates 72*a*. The guide 71 has a long shape in the first direction X1 to be stretched between two mutually adjacent switch plates 72*a*. The guide 71 includes a plurality (for example, three in the embodiment) of guide plates 71*a*, 71*b*, and 71*c* (a first guide plate 71*a*, a second guide plate 71*b*, and a third guide plate 71*c*). The plurality of guide plates 71*a*, 71*b*, and 71*c* are disposed at intervals in the second direction X2 intersecting the first direction X1. The guide plates 71*a*, 71*b*, and 71*c* have a long shape in the first direction X1 and have a rectangular plate shape with a thickness in the second direction X2. The plurality of guide plates 71*a*, 71*b*, and 71*c* have substantially the same outer appearance.

The locking members 73 are disposed on both ends of the guide unit 70 in the first direction X1. The locking members 73 include locking pieces 73*a* that lock to be rotatable about the spindle 91*a*.

The connection members 74 connect the switch plates 72*a* to the locking members 73 disposed at both ends of the switch member 72 in the first direction X1. The connection members 74 are formed in a rectangular plate shape with a thickness in the second direction X2. The thickness of the connection member 74 is thicker than the thickness of the guide plates 71*a*, 71*b*, and 71*c*.

Figure 5:
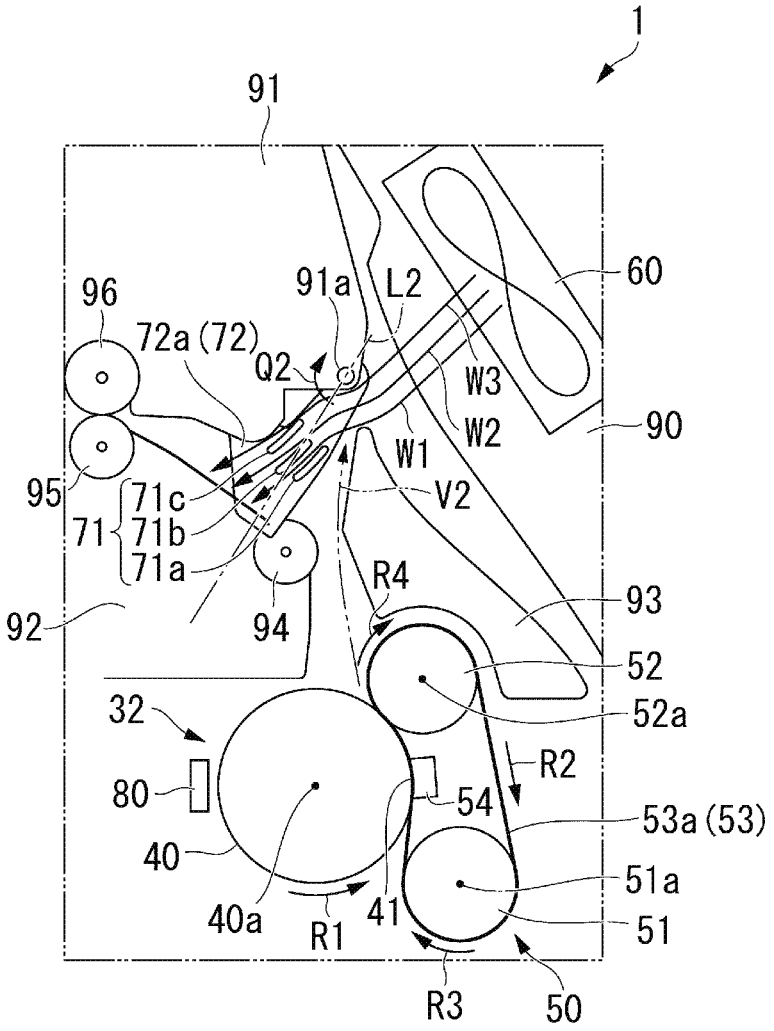
FIG. 5 is a diagram illustrating an operation of the guide unit according to the embodiment.

FIG. 5 is a diagram illustrating an operation of the guide unit 70 according to the embodiment.

The guide unit 70 is movable to a first position and a second position by a driving mechanism (not illustrated). Here, the first position is a position at which the wind generated from the fan 60 is guide to the nip 41 of the fixing device 32 (see FIG. 3). At the first position in FIG. 3, the wind flows toward the nip 41 by the plurality of guide plates 71*a*, 71*b*, and 71*c* in the directions of the arrows W1, W2, and W3. Here, the arrow W1 indicates a flow of wind passing between the first guide plate 71*a* and the second guide plate 71*b*. The arrow W2 indicates a flow of wind passing between the second guide plate 71*b* and the third guide plate 71*c*. The arrow W3 indicates a flow of wind passing between the third guide plate 71*c* and the spindle 91*a*.

The second position is a position at which the wind from the fan 60 is guided to a portion different from the nip 41 of the fixing device 32. Specifically, the second position is a position at which the wind is guided to the side of the temperature sensor 80 (see FIG. 5). In FIG. 5, at the second position, the wind flows toward the side of the temperature sensor 80 in the directions of the arrows W1, W2, and W3 by the plurality of guide plates 71*a*, 71*b*, and 71*c*.

In the state of FIG. 3, the guide unit 70 is rotated about the spindle 91*a* in the direction of the arrow Q1 to overlap the transport path forming unit 93. Here, a virtual straight line L1 connecting the center of the spindle 91*a* to a downstream end of the nip 41 is set. In the state of FIG. 3, the plurality of guide plates 71*a*, 71*b*, and 71*c* follow the virtual straight line L1. Accordingly, the wind is guided to the nip 41 by the plurality of guide plates 71*a*, 71*b*, and 71*c*.

In the state of FIG. 5, the guide unit 70 is rotated about the spindle 91*a* in the direction of the arrow Q2 to overlap the transport path forming unit 92 and the transport roller 94. Here, a virtual straight line L2 connecting the center of the spindle 91*a* and an inclined surface of the transport path forming unit 92 is set. In other words, the virtual straight line L2 is a normal line of the inclined surface of the transport path forming unit 92 and is a virtual line passing through the center of the spindle 91*a*. In the state of FIG. 5, the plurality of guide plates 71*a*, 71*b*, and 71*c* follow the virtual straight line L2. The virtual straight line L2 extends toward the opposite side (that is, the side of the temperature sensor 80) to the nip 41 of the heating roller 40. Accordingly, the wind is guided to the side of the temperature sensor 80 by the plurality of guide plates 71*a*, 71*b*, and 71*c*.

Next, the temperature sensor 80 will be described.

As illustrated in FIG. 3, the temperature sensor 80 is disposed near the fixing device 32. The temperature sensor detects the temperature of the fixing device 32. Specifically, the temperature sensor 80 faces the heating roller 40. For example, the temperature sensor 80 is a noncontact thermometer such as a radiation thermometer. The temperature sensor 80 detects the temperature of the heating roller 40. A detection result (heating roller temperature) of the temperature sensor 80 is output as a temperature signal of the heating roller temperature to a wind quantity control unit 101*c* (see FIG. 6).

Next, types of image forming processes performed by the image forming apparatus 1 (see FIG. 1) according to the embodiment will be described. The image forming apparatus 1 performs printing in three modes to be described below:

- a monochromatic toner mode in which an image is formed with non-decolorable monochromatic black toner;
- a colorable toner mode in which an image is formed with non-decolorable monochromatic toner and colorable toner; and
- a decolorable toner mode in which an image is formed with only decolorable toner.

A mode in which an image is to be formed can be selected when the user operates the display unit 110 of the image forming apparatus 1.

In the monochromatic toner mode, an image is formed when the image generation unit using the black (K) non-decolorable toner operates. The monochromatic toner mode is a mode selected when the user desires to print a general monochromatic image. For example, the monochromatic toner mode is used when the user desires to store an important material or the like without reusing paper.

In the colorable toner mode, an image is formed when four image generation units using non-decolorable toner of yellow (Y), magenta (M), cyan (C), and black (K) operate. The colorable toner mode is a mode selected when the user desires to print a color image.

In the decolorable toner mode, an image is formed when only the image generation unit using the decolorable toner operates. The decolorable toner mode is a mode selected when a sheet on which an image is formed is reused.

The fixing device 32 is controlled between a fixing mode and a decolorizing mode. In the fixing mode, a toner image is fixed to a sheet. In the decolorizing mode, a toner image is decolorized from a sheet. In the decolorizing mode, the temperature of the heating roller 40 is set to be higher than in the fixing mode. That is, the control unit 101 to be described below operates the fixing device 32 with at least two target temperatures. Specifically, two target temperatures of the fixing device 32 is stored in a memory 104 to be described below. The control unit 101 calls the target temperature from the memory 104 according to the selected mode and operates the fixing device 32. The two target temperatures are set to first and second temperatures. Here, the first temperature is a temperature of the decolorizing mode. The second temperature is a temperature of the fixing mode. That is, the second temperature is a temperature lower than the first temperature.

As illustrated in FIG. 1, the display unit 110 includes buttons 150 (an operation unit) used to operate the guide unit 70 when the fixing device 32 is switched from the decolorizing mode to the fixing mode.

Next, a functional configuration of the image forming apparatus 1 will be described.

FIG. 6 is a block diagram illustrating an example of the functional configuration of the image forming apparatus 1 according to the embodiment.

As illustrated in FIG. 6, functional units of the image forming apparatus 1 are connected to enable data communication through a system bus 100.

The control unit 101 controls an operation of each functional unit of the image forming apparatus 1. The control unit 101 performs various processes by executing programs. The control unit 101 acquires instructions input by the user from the display unit 110. The control unit 101 performs a control process based on an acquired instruction.

A network interface 102 performs transmission and reception of data between another apparatus. The network interface 102 operates as an input interface and receives data transmitted from another apparatus. The network interface 102 also operates as an output interface and transmits data to another apparatus.

A storage device 103 stores various kinds of data. For example, the storage device 103 is a hard disk or a solid state drive (SSD). For example, various kinds of data are digital data, screen data of setting screens, setting information, and jobs, and job logs. The digital data is data generated by the image reading unit 120. The setting screen is a screen on which operation setting of the guide unit 70 is performed. The setting information is information regarding the operation setting of the guide unit 70.

The memory 104 temporarily stores data to be used by each functional unit. The memory 104 is, for example, a random access memory (RAM). For example, the memory 104 temporarily stores the digital data, the jobs, and the job logs.

Next, an operation of the guide unit 70 at the time of switching of the fixing device 32 from the decolorizing mode to the fixing mode will be described.

The control unit 101 controls the fan 60 and the guide unit 70 when the control unit 101 controls the heating roller 40 such that the heating roller 40 driven at the first temperature is driven at the second temperature. Normally, the fan 60 and the guide unit 70 are stopped. The control unit 101 drives the fan 60 and the guide unit 70 at a timing at which the control unit 101 controls the heating roller 40 such that the heating roller 40 driven at the first temperature is driven at the second temperature.

The control unit 101 includes an oscillation control unit 101*a* that controls the guide unit 70 such that the guide unit 70 is oscillated between the first and second positions. The oscillation control unit 101*a* performs control such that the guide unit 70 is oscillated when the oscillation control unit 101*a* controls the heating roller 40 such that the heating roller 40 driven at the first temperature is driven at the second temperature. The oscillation control unit 101*a* performs control such that the guide unit 70 is oscillated when the oscillation control unit 101*a* controls the heating roller 40 such that the heating roller 40 driven in the decolorizing mode is driven at the fixing mode. That is, the oscillation control unit 101*a* performs control such that the guide unit 70 is oscillated when the fixing device 32 is switched from the decolorizing mode to the fixing mode. Accordingly, the wind from the fan 60 is alternately guided to the nip 41 and the side of the temperature sensor 80 by the plurality of guide plates 71*a*, 71*b*, and 71*c* of the guide unit 70. For example, when the fixing device 32 is switched from the decolorizing mode to the fixing mode, the user selects the fixing mode and presses the button 150 so that the guide unit 70 is oscillated by a driving mechanism (not illustrated). That is, the guide unit 70 alternately switches between the state of FIG. 3 and the state of FIG. 5.

Conversely, when the fixing device 32 is in the decolorizing mode, the oscillation control unit 101*a* does not oscillate the guide unit 70.

Next, an operation of the guide unit 70 according to a detection result of the temperature sensor 80 will be described.

The control unit 101 further includes a contrast unit 101*b* and the wind quantity control unit 101*c*.

The contrast unit 101*b* contrasts a detection result of the temperature sensor 80 to a preset threshold. For example, the threshold is set to be equal to or less than a temperature of the decolorizing mode and equal to or greater than a temperature of the fixing mode. That is, the threshold is set to be equal to or less than the first temperature and equal to or greater than the second temperature.

Based on a contrast result of the contrast unit 101*b*, the wind quantity control unit 101*c* controls the fan 60 such that the quantity of wind guide to the heating roller 40 increases when the temperature of the fixing device 32 is higher than the threshold. That is, the wind quantity control unit 101*c* increases an output of the fan 60 so that the quantity of wind guide to the heating roller 40 increases when the heating roller temperature is higher than the threshold.

When the fixing device 32 is in the decolorizing mode, the wind quantity control unit 101*c* may decrease the output of the fan 60 so that the quantity of wind guided to the heating roller 40 decreases. For example, when the fixing device 32 is in the decolorizing mode, wind quantity control unit 101*c* may turn off the fan 60.

Incidentally, when the decolorizing mode is switched to the fixing mode, it can also be considered that the heating roller 40 performs idle running for natural cooling. However, within only the idle running of the heating roller 40, it may take a long cooling time. Therefore, there is a possibility that a time in which a user may not use the image forming apparatus 1 occurs.

According to the embodiment, the image forming unit 130, the heating roller 40, the fan 60, and the guide 71, and the control unit 101 are included. The image forming unit 130 forms an image on a sheet. The heating roller 40 is disposed on the downstream side of the image forming unit 130 in the sheet transport direction. The heating roller 40 is driven with at least two temperatures, the first temperature and the second temperature lower than the first temperature. The fan 60 generates wind. The guide 71 guides the wind generated from the fan 60 to the heating roller 40. The control unit 101 controls the fan 60 and the guide 71 when the control unit 101 controls the heating roller 40 such that the heating roller 40 driven at the first temperature is driven at the second temperature. In the foregoing configuration, the following advantages are obtained. When the heating roller 40 is driven at the second temperature, the wind of the fan 60 cools the heating roller 40. Therefore, it is possible to shorten a cooling time of the fixing device 32 further than when the heating roller 40 performs idle running for natural cooling. Accordingly, it is possible to suppress occurrence of a time in which the user may not use the image forming apparatus 1. Further, since the wind can be guided to the heating roller 40 more reliably by the guide 71, it is possible to shorten the cooling time of the fixing device 32 more efficiently.

The guide unit 70 can be moved to the first and second positions, and thus the following advantages are obtained. The fixing device 32 can be further prevented from being cooled locally than when the guide unit 70 is maintained at a fixed position. For example, at the first position, the wind can be guided to the nip 41 to cool the vicinity of the nip 41. At the second position, on the other hand, the wind can be detoured from the side of the temperature sensor 80 to cool the outer circumference portion of the fixing device 32. Accordingly, it is possible to evenly cool the entire fixing device 32.

The guide 71 is formed to be integrated with the switch member 72, the following advantages are obtained. The configuration of the apparatus can be simplified further than when the guide 71 is installed to be separated independently from the switch member 72. Further, since a peripheral space (a wind guiding space) of the switch member 72 can be sufficiently ensured, it is possible to guide the wind to the heating roller 40 more efficiently.

The control unit 101 performs controls such that the guide unit 70 is oscillated between the first and second positions, and thus the following advantages are obtained. The fixing device 32 can be further prevented from being cooled locally than when the guide unit 70 is maintained at only one of the first and second positions. For example, it is possible to alternately repeat the cooling of the vicinity of the nip 41 and the cooling of the outer circumference of the heating roller 40. Accordingly, it is possible to evenly cool the entire fixing device 32 more reliably.

When the control unit 101 controls the heating roller 40 such that the heating roller 40 driven at the first temperature is driven at the second temperature, the control unit 101 performs control such that the guide unit 70 is oscillated, and thus the following advantage can be obtained. Since the guide unit 70 is automatically oscillated at an appropriate timing, it is possible to cool the fixing device 32 more reliably.

When the control unit 101 controls the heating roller 40 such that the heating roller 40 driven in the decolorizing mode is driven in the fixing mode, the control unit 101 performs control such that the guide unit 70 is oscillated, and thus the following advantage can be obtained. Since the temperature of the fixing device 32 can be set to an appropriate temperature smoothly at the time of the switch to the fixing mode, it is possible to further effectively suppress occurrence of a time in which the user may not use the image forming apparatus 1.

The fan 60 and the guide unit 70 are disposed on the downstream side of the heating roller 40 in the sheet transport direction, and thus the following advantage is obtained. Incidentally, since the image forming unit 130 is disposed on the upstream side of the heating roller 40 in the sheet transport direction, there is a possibility of disposition spaces of these fan 60 and the guide unit 70 not being sufficiently ensured. According to the embodiment, however, since the image forming unit 130 is not obstructed, it is possible to sufficiently ensure the disposition spaces of the fan 60 and the guide unit 70. Further, since a wind guiding space can also be sufficiently ensured, it is possible to further efficiently guide the wind to the heating roller 40.

The switch member 72 includes the plurality of switch plates 72*a* disposed at intervals in the first direction X1 intersecting the transport path, and thus the following advantage is obtained. Since the switch plates 72*a* can be brought into contact with a plurality of portions of a sheet, it is possible to reliably transport the sheet.

The guide 71 is joined to the plurality of switch plates 72*a* and has the long shape in the first direction X1 to be stretched between two mutually adjacent switch plates 72*a*, and thus the following advantage is obtained (in this case long means a greater distance than the distance in direction perpendicular to direction X1, such as X2). Since the wind passing between the two mutually adjacent switch plates 72*a* can be guided to the heating roller 40 by the guide 71, it is possible to further efficiently cool the fixing device 32. Further, since the plurality of switch plates 72*a* are connected by the guide 71, it is possible to improve rigidity of the guide unit 70.

The guide 71 includes the plurality of guide plates 71*a*, 71*b*, and 71*c* disposed at intervals in the second direction X2 intersecting the first direction Xl, and thus the following advantage is obtained. Since a wind rectification effect can be improved further than when the guide 71 includes only one guide plate, it is possible to further reliably guide the wind to the heating roller 40. Accordingly, it is possible to further effectively cool the fixing device 32.

When the temperature of the heating roller 40 is higher than the threshold, the control unit 101 controls the fan 60 such that the quantity of wind guided to the heating roller 40 increases, and thus the following advantage is obtained. Since the quantity of wind of the fan 60 can be automatically increased at an appropriate timing, it is possible to more reliably cool the fixing device 32.

Hereinafter, modification examples will be described.

The fixing device 32 is not limited to the configuration in which the heating source is included inside the heating roller 40. For example, the heating source may be disposed on the side of the pressurizing pad 54 or the side of the rollers 51 and 52.

The fixing device 32 is not limited to a lamp heating type. For example, the fixing device 32 may be of an electromagnetic induction type (IH type) in which an electromagnetic induction heating is performed on a conductive layer of a belt.

The pressurizing member is not limited to the pressurizing pad 54 in the rectangular parallelepiped state. For example, the pressurizing member may be a roller that has a curved outer circumferential surface.

The plurality of rollers 51 and 52 are not limited to the configuration in which the first roller 51 and the second roller 52 are included. For example, the plurality of rollers maybe configured to include a plurality of three or more rollers.

The first roller 51 and the second roller 52 are not limited to the configuration in which the first roller 51 and the second roller 52 come into contact with the inner circumferential surface of the belt 53 by the rotation of the heating roller 40 and follow the belt 53 to be rotated. For example, at least one of the first roller 51 and the second roller 52 may be rotated independently from the heating roller 40. That is, the heating roller 40 may come into contact with the outer circumferential surface of the belt 53 rotated by the rotation of at least one of the first roller 51 and the second roller 52 and follow the belt 53 to be rotated.

The guide unit 70 is not limited to a movable type. For example, the guide unit 70 may be of a fixed type.

The guide 71 is not limited to the configuration in which the guide 71 is formed to be integrated with the switch member 72. For example, the guide 71 may be installed to be separated from the switch member 72.

The output of the fan 60 is not limited to being controlled. For example, when the fan 60 is turned on, the fan 60 may be driven at a rated output.

The oscillation control unit 101*a* is not limited to the configuration in which the guide unit 70 is controlled to be oscillated when the fixing device 32 is switched from the decolorizing mode to the fixing mode. For example, in the colorable toner mode, the guide unit 70 may be controlled to be oscillated when the fixing device 32 is dropped from the first temperature to the second temperature.

Here, a mode in which the non-decolorable toner is fixed to a normal paper is referred to as a "normal paper mode". A mode in which the non-decolorable toner is fixed to a thicker paper than a normal paper is referred to as a "thick paper mode." A temperature of the heating roller 40 in the thick paper mode is referred to as a "fixing temperature of the thick paper mode". A temperature of the heating roller 40 in the normal paper mode is referred to as a "fixing temperature of the normal paper mode". When the fixing temperature of the thick paper mode is set to be lower than the fixing temperature of the normal paper mode, the following advantage is obtained. Normally, since it is more difficult to perform fixing in a thick paper than in a normal paper, the fixing temperature of the thick paper mode is set to be higher than the fixing temperature of the normal paper mode in some cases. However, when a transport speed of a thick paper is set to be less than a transport speed of a normal paper and the fixing temperature of the thick paper mode is set to be higher than the fixing temperature of the normal paper mode, there is a possibility of a fixing failure occurring due to overheating of the thick paper. According to a modification example, however, even when a transport speed of a thick paper is set to be less than a transport speed of a normal paper, it is possible to prevent the thick paper from being overheated. Therefore, it is possible to prevent a fixing failure from occurring.

When the control unit 101 controls the heating roller 40 such that the heating roller 40 driven in the normal paper mode is driven in the thick paper mode, the control unit 101 may control the fan 60 and the guide unit 70. That is, the control unit 101 may drive the fan 60 and the guide unit 70 when a target temperature of the fixing device 32 is changed (for example, a target temperature is lowered). In other words, the control unit 101 may drive the fan 60 and the guide unit 70 in order to lower the temperature of the fixing device 32 at the time of change of the mode. For example, when the fixing device 32 is switched from the decolorizing mode to the decolorable toner mode, the fan 60 can be driven so that a first copy time can be shortened.

The guide 71 is not limited to the configuration in which the three guide plates 71*a*, 71*b*, and 71*c* are included. For example, the guide 71 may include a plurality of four or more guide plates. The number of guide plates may be appropriately changed.

Figure 7:
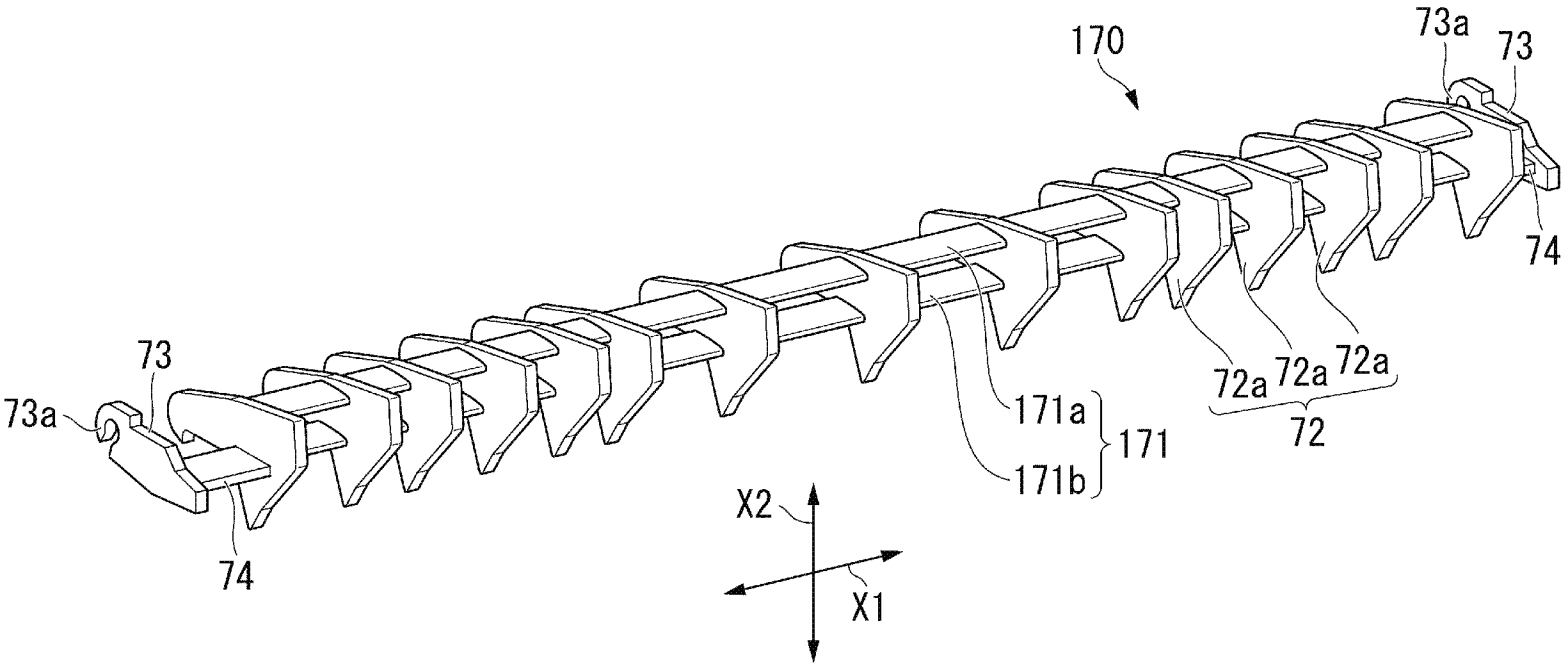
FIG. 7 is a perspective view illustrating a first modification example of the guide unit according to the embodiment.

FIG. 7 is a perspective view illustrating a first modification example of the guide unit according to the embodiment.

As illustrated in FIG. 7, a guide unit 170 includes a guide 171, a switch member 72, locking members 73, and connection members 74. The guide 171 includes a plurality (for example, two in the modification example) of guide plates 171*a* and 171*b*. The plurality of guide plates 171*a* and 171*b* are disposed at intervals in the second direction X2 intersecting the first direction X1. The guide plates 171*a* and 171*b* have a long shape in the first direction X1 and have a rectangular plate shape with a thickness in the second direction X2. The plurality of guide plates 171*a* and 171*b* have substantially the same outer appearance.

According to the modification example, it is possible to achieve simplification and reduction in the weights of the guide unit 170 compared to the case in which the three guide plates 71*a*, 71*b*, and 71*c* are included.

Figure 8:
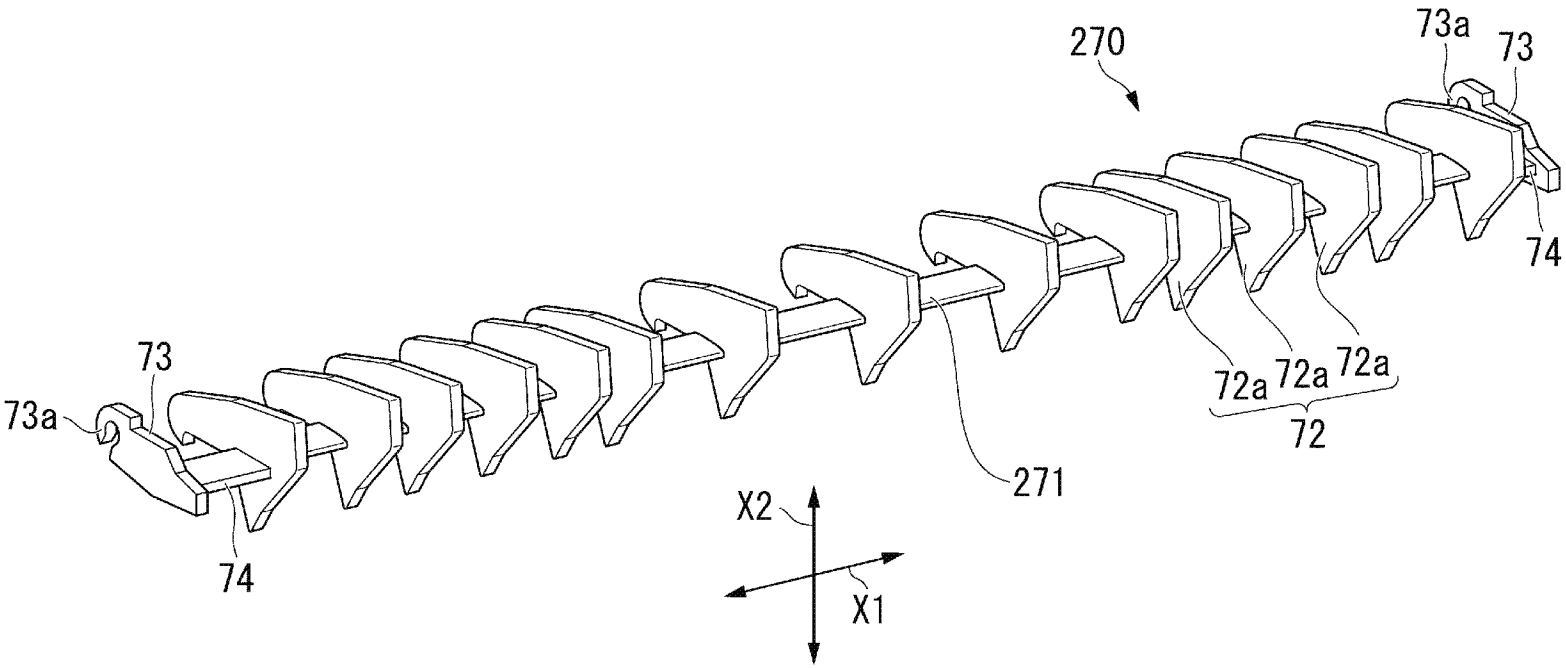
FIG. 8 is a perspective view illustrating a second modification example of the guide unit according to the embodiment.

FIG. 8 is a perspective view illustrating a second modification example of the guide unit according to the embodiment.

As illustrated in FIG. 8, a guide unit 270 includes a guide 271, a switch member 72, locking members 73, and connection members 74. The guide 271 is a single guide plate. The guide plate 271 has a long shape in the first direction X1 and has a rectangular plate shape with a thickness in the second direction X2.

According to the modification example, it is possible to achieve simplification and reduction in the weights of the guide unit 270 compared to the case in which the two guide plates 171*a* and 171*b* are included.

Next, an example of the operation of the image forming apparatus 1 will be described.

Figure 9:
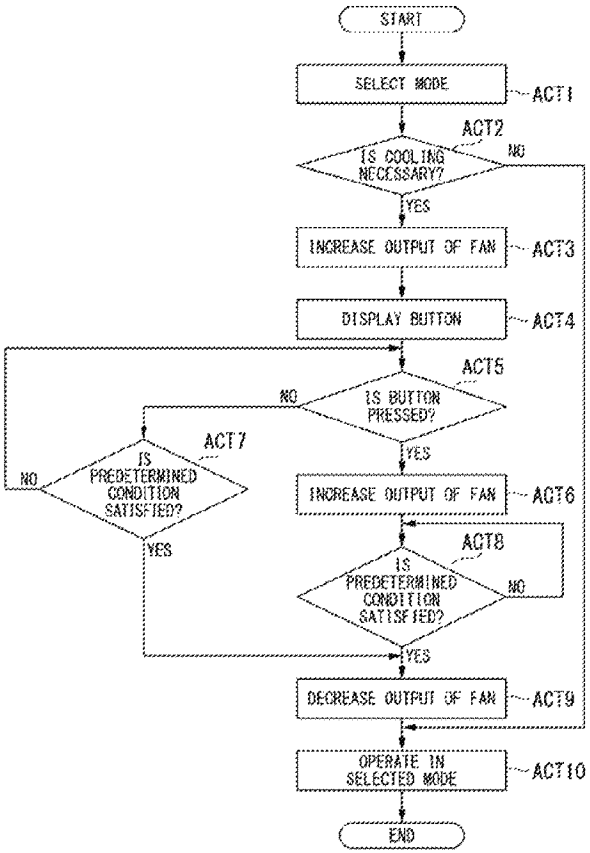
FIG. 9 is a flow chart illustrating an example of an operation of the image forming apparatus according to the embodiment.

FIG. 9 is a flowchart showing an example of the operation of the image forming apparatus 1 according to the embodiment.

The image forming apparatus 1 operates to execute ACT1 to ACT10 shown in FIG. 9 in accordance with the flow shown in FIG. 9.

A mode for operating the image forming apparatus 1 is selected in ACT1. For example, the following modes are included.

Non-decolorable toner mode: images are formed with a non-decolorable toner

Monochrome toner mode: images are formed with a non-decolorable black monochrome toner Colorable toner mode: images are formed with a non-decolorable monochrome toner and a colorable toner Decolorable toner mode: images are formed only with a decolorable toner Decolorizing mode: images are decolorized from a sheet Normal paper mode: the non-decolorable toner is fixed on normal paper Thick paper mode: the non-decolorable toner is fixed on thick paper thicker than normal paper After the mode is selected, ACT2 is executed.

In ACT2, the control unit 101 determines whether cooling of the fixing device 32 is necessary. A case in which the cooling of the fixing device 32 is necessary is a case in which the temperature of the fixing device 32 may be higher than the threshold value. A case in which the cooling of the fixing device 32 is not necessary is a case in which the temperature of the fixing device 32 may be equal to or lower than the threshold value.

When the cooling of the fixing device 32 is necessary (ACT2: YES), ACT3 is executed.

When the cooling of the fixing device 32 is not necessary (ACT2: NO), ACT10 is executed.

In ACT3, the control unit 101 increases the output of the fan 60. That is, when the cooling of the fixing device 32 is necessary, the wind quantity control unit 101*c* increases the output of the fan 60 so that a quantity of wind guided to the heating roller 40 increases.

After ACT3, ACT4 is executed. In ACT4, the control unit 101 displays the button 150 on the display unit 110.

The control unit 101 displays the button 150 on the display unit 110 when a first mode is switched to a second mode. For example, combinations of the first mode and the second mode include the following.

The first mode is the decolorizing mode and the second mode is the decolorable toner mode.

The first mode is the non-decolorable toner mode and the second mode is the decolorable toner mode.

The first mode is the monochrome toner mode and the second mode is the colorable toner mode.

The first mode is the colorable toner mode and the second mode is the monochrome toner mode.

The first mode is the normal paper mode and the second mode is the thick paper mode.

For example, the control unit 101 displays the button 150 on the display unit 110 when the decolorizing mode is switched to the decolorable toner mode. For example, the control unit 101 displays the button 150 on the display unit 110 when the non-decolorable toner mode is switched to the decolorable toner mode.

For example, the control unit 101 displays the button 150 on the display unit 110 when the fixing temperatures of toners are different from each other. For example, in a case in which the colorable toner has a lower fixing temperature than the monochrome toner, the control unit 101 displays the button 150 on the display unit 110 when the monochrome toner mode is switched to the colorable toner mode. For example, in a case in which the monochrome toner has a lower fixing temperature than the colorable toner, the control unit 101 displays the button 150 on the display 110 when the colorable toner mode is switched to the monochrome toner mode.

For example, the control unit 101 displays the button 150 on the display unit 110 when types of sheets are different from each other. For example, the control unit 101 displays the button 150 on the display unit 110 when the normal paper mode is switched to the thick paper mode.

Next, an example of the button 150 will be described.

Figure 10:
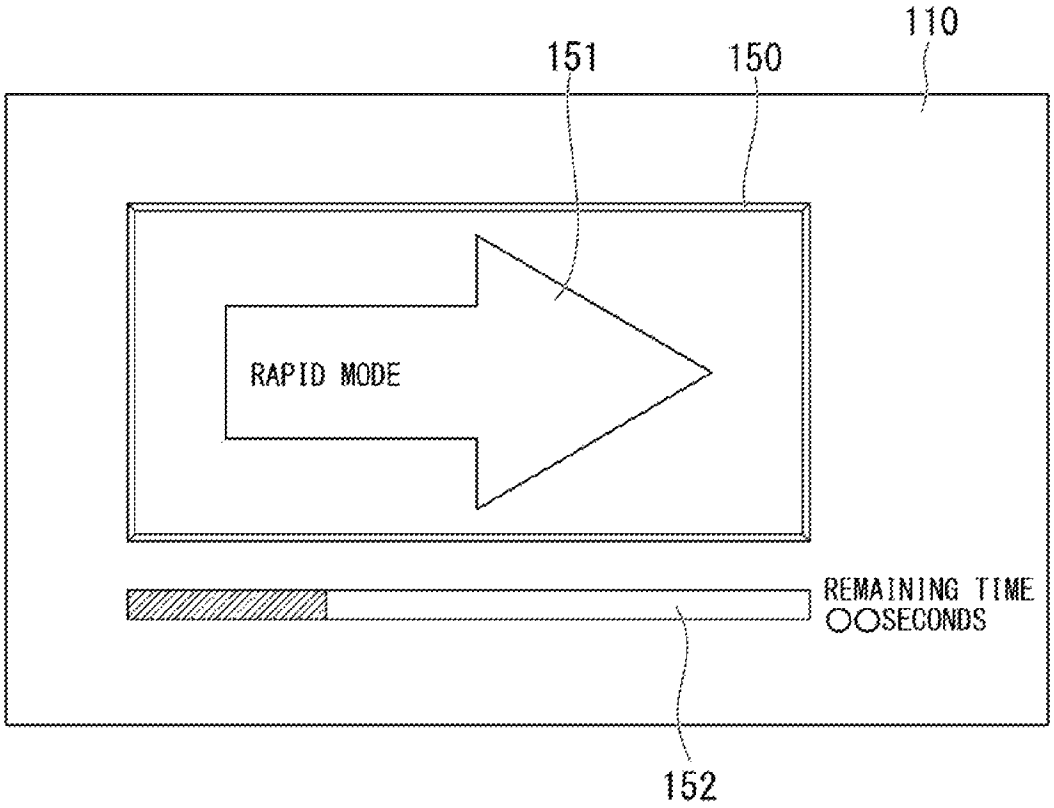
FIG. 10 is a diagram illustrating an example of a button on a display unit according to the embodiment.

FIG. 10 is a diagram showing an example of the button on the display unit according to the embodiment.

As shown in FIG. 10, an arrow 151 facing right is drawn on the button 150. Text indicating a rapid mode is written on the arrow 151. A remaining time until the completion of cooling is displayed below the button 150. Specifically, a gauge 152 which moves to the right as the remaining time becomes shorter is disposed below the button 150. To the right of the gauge 152, text indicating the remaining time is displayed. When a user waits in front of the image forming apparatus 1, the user can visually ascertain the remaining time until the completion of cooling.

After ACT4, ACT5 is executed. In ACT5, the control unit 101 determines whether the button 150 is pressed.

When the button 150 is pressed (ACT5: YES), ACT6 is executed.

When the button 150 is not pressed (ACT5: NO), ACT7 is executed.

In ACT6, the control unit 101 increases the output of the fan 60. The control unit 101 increases the output of the fan 60 more than in ACT3. That is, when the button 150 is pressed, the wind quantity control unit 101*c* increases the output of the fan 60 so that the quantity of wind guided to the heating roller 40 is more than in ACT3. In ACT6, the rapid mode which shortens the cooling time of the fixing device 32 is executed.

After ACT6, ACT8 is executed. In ACT8, the control unit 101 determines whether a predetermined condition is satisfied. Here, the following predetermined conditions are included.

Time condition: the preset time is reached.

Temperature condition: the temperature of the heating roller 40 reaches a predetermined temperature.

For example, the set time is stored in the memory 104. For example, the temperature of the heating roller 40 is detected by the temperature sensor 80 at all times.

When the predetermined condition is satisfied (ACT8: YES), ACT9 is executed. Here, a case in which the predetermined condition is satisfied means a case in which at least one of the time condition and the temperature condition is satisfied.

When the predetermined condition is not satisfied (ACT8: NO), the procedure returns to ACT8. Here, a case in which the predetermined condition is not satisfied means a case in which neither the time condition nor the temperature condition is satisfied.

In ACT7, in the same manner as in ACT8, the control unit 101 determines whether the predetermined condition is satisfied.

When the predetermined condition is satisfied (ACT7: YES), ACT9 is executed.

When the predetermined condition is not satisfied (ACT7: NO), the procedure returns to ACT5.

In ACT9, the control unit 101 decreases the output of the fan 60. For example, the control unit 101 decreases the output of the fan 60 when the temperature of the heating roller 40 reaches a predetermined temperature. For example, the control unit 101 decreases the output of the fan 60 when the preset time is reached. That is, the wind quantity control unit 101*c* decreases the output of the fan 60 so that the quantity of wind guided to the heating roller 40 is decreased when the predetermined condition is satisfied. For example, when the predetermined condition is satisfied, the wind quantity control unit 101*c* may turn the fan 60 off.

After ACT9, ACT10 is executed. In ACT10, the image forming apparatus 1 operates in a selected mode.

The control unit 101 displays the button 150 on the display unit 110, and when the button 150 is pressed, the control unit 101 increases the output of the fan 60, thereby obtaining the following effect. Compared with a case in which the output of the fan 60 is made constant, it is possible to cool the fixing device 32 in a shorter time.

The control unit 101 displays the button 150 on the display unit 110 when the first mode is switched to the second mode, thereby obtaining the following effect. When the mode is switched, it is possible to cool the fixing device 32 in a short time as required.

The control unit 101 decreases the output of the fan 60 when the temperature of the heating roller 40 reaches a predetermined temperature, thereby obtaining the following effect. It is possible to prevent the fixing device 32 from being excessively cooled.

The control unit 101 decreases the output of the fan 60 when the preset time is reached, thereby obtaining the following effect. It is possible to prevent the fixing device 32 from being excessively cooled.

The control unit 101 displays the button 150 on the display unit 110 when the fixing temperatures of toners are different from each other, thereby obtaining the following effect. When the fixing temperatures of toners are different from each other, it is possible to cool the fixing device 32 in a short time as required.

The control unit 101 displays the button 150 on the display unit 110 when the types of sheets are different from each other, thereby obtaining the following effect. When the types of sheets are different from each other, it is possible to cool the fixing device 32 in a short time as required.

The first mode is the decolorizing mode and the second mode is the decolorable toner mode, and thereby the following effect is obtained. When the decolorizing mode is switched to the decolorable toner mode, the button 150 is displayed on the display unit 110, and thus it is possible to cool the fixing device 32 in a short time as required.

The first mode is the non-decolorable toner mode and the second mode is the decolorable toner mode, and thereby the following effect is obtained. When the non-decolorable toner mode is switched to the decolorable toner mode, the button 150 is displayed on the display unit 110, and thus it is possible to cool the fixing device 32 in a short time as required.

The first mode is the monochrome toner mode and the second mode is the colorable toner mode, and thereby the following effect is obtained. In a case in which the colorable toner has a lower fixing temperature than the monochrome toner, it is possible to cool the fixing device 32 in a short time as required when the monochrome toner mode is switched to the colorable toner mode.

The first mode is the colorable toner mode and the second mode is the monochrome toner mode, and thereby the following effect is obtained. In a case in which the monochrome toner has a lower fixing temperature than the colorable toner, it is possible to cool the fixing device 32 in a short time as required when the colorable toner mode is switched to the monochrome toner mode.

The first mode is the normal paper mode and the second mode is the thick paper mode, and thereby the following effect is obtained. When the normal paper mode is switched to the thick paper mode, the button 150 is displayed on the display unit 110, and thus it is possible to cool the fixing device 32 in a short time as required.

According to at least one of the above-described embodiments, the image forming unit 130, the heating roller 40, the fan 60, and the guide 71, and the control 101 are included. The image forming unit 130 forms an image on a sheet. The heating roller 40 is disposed on the downstream side of the image forming unit 130 in the sheet transport direction. The heating roller is driven with at least two temperatures, the first temperature and the second temperature lower than the first temperature. The fan 60 generates wind. The guide 71 guides the wind generated from the fan 60 to the heating roller 40. The control unit 101 controls the fan 60 and the guide 71 when the control unit 101 controls the heating roller 40 such that the heating roller 40 driven at the first temperature is driven at the second temperature. In the foregoing configuration, the following advantage is obtained. When the heating roller 40 is driven at the second temperature, the wind of the fan 60 can cool the heating roller 40. Therefore, it is possible to shorten a cooling time of the fixing device 32 further than when the heating roller 40 performs idle running for natural cooling. Accordingly, it is possible to suppress occurrence of a time in which the user may not use the image forming apparatus 1.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

an image forming unit that forms an image on a recording medium;

a heating unit that is disposed on a downstream side of the image forming unit in a transport direction of the recording medium and is driven with at least two temperatures, a first temperature and a second temperature lower than the first temperature;

a fan that generates wind;

a guide that guides the wind generated from the fan to the heating unit; and a control unit that controls the fan and the guide when the control unit switches driving the heating unit between the first temperature and the second temperature, wherein the guide extends in a first direction intersecting a transport path of the recording medium, and wherein the guide comprises a plurality of guide plates disposed at intervals in a second direction intersecting the first direction.

2. The image forming apparatus according to claim 1, further comprising:

a rotator that faces the heating unit, wherein a nip is formed between the heating unit and the rotator, and the guide is movable to a first position at which the wind is guided to the nip and a second position at which the wind is guided to a portion of the heating unit different from the nip.

3. The image forming apparatus according to claim 1, further comprising:

a switch member that switches the transport path of the recording medium, wherein the guide is formed so as to be integrated with the switch member.

4. The image forming apparatus according to claim 2, wherein the control unit performs control such that the guide is oscillated between the first and second positions.

5. The image forming apparatus according to claim 4, wherein the control unit performs control such that the guide is oscillated when the control unit changes driving the heating unit from the first temperature to the second temperature.

6. The image forming apparatus according to claim 4, wherein the control unit performs control such that the guide is oscillated when the control unit changes driving the heating unit from a decolorizing mode in which the image is decolorized from the recording medium to a fixing mode in which the image is fixed to the recording medium.

7. The image forming apparatus according to claim 1, wherein the fan and the guide are disposed on a downstream side of the heating unit in the transport direction of the recording medium.

8. The image forming apparatus according to claim 3, wherein the switch member comprises a plurality of switch plates disposed at intervals in the first direction intersecting the transport path, and the guide is joined to the plurality of switch plates and extends in the first direction to be stretched between two mutually adjacent switch plates.

9. The image forming apparatus according claim 1, further comprising:

a temperature sensor that detects temperature of the heating unit, wherein the control unit controls the fan such that a quantity of wind guided to the heating unit is increased when the temperature of the heating unit is higher than a preset threshold.

10. The image forming apparatus according claim 1, wherein the guide is rotable about a spindle, wherein a virtual straight line connecting a center of the spindle to a downstream end of a nip is set, and wherein the plurality of guide plates follow the virtual straight line at a position at which the wind generated from the fan is guide to the nip.

11. A method of operating an image forming apparatus, comprising:

forming an image on a recording medium;

driving a heating unit with at least two temperatures, a first temperature and a second temperature lower than the first temperature;

generating wind;

guiding the wind to the heating unit; and controlling the wind and guiding the wind when switching driving the heating unit between the first temperature and the second temperature, wherein the guide extends in a first direction intersecting a transport path of the recording medium, and wherein guiding the wind comprises using a plurality of guide plates disposed at intervals in a second direction intersecting the first direction.

12. The method according to claim 11, further comprising:

forming a nip between the heating unit and a rotator, and guiding wind to the nip or away from the nip.

13. The method according to claim 11, further comprising:

switching the transport path of the recording medium.

14. The method according to claim 12, wherein guiding the wind comprises oscillating the wind between a first position to the nip and a second position away from the nip.

15. The method according to claim 14, wherein guiding the wind comprises oscillating the wind when changing driving the heating unit from the first temperature to the second temperature.

16. The method according to claim 14, wherein guiding the wind comprises oscillating the wind when changing driving the heating unit from a decolorizing mode in which an image is decolorized from the recording medium to a fixing mode in which the image is fixed to the recording medium.

17. The method according to claim 11, wherein guiding the wind is conducted on a downstream side of the heating unit in a transport direction of the recording medium.

18. The method according to claim 13, wherein a switch member comprising a plurality of switch plates is disposed at intervals in the first direction intersecting the transport path.

19. The method according claim 11, further comprising:

detecting temperature of the heating unit, and generating the wind such that a quantity of wind guided to the heating unit is increased when the temperature of the heating unit is higher than a preset threshold.

20. The method according claim 11, wherein the guide is rotable about a spindle, wherein a virtual straight line connecting a center of the spindle to a downstream end of a nip is set, wherein the plurality of guide plates follow the virtual straight line at a position at which the wind generated from the fan is guide to the nip.

21. The image forming apparatus according to claim 1, further comprising:

a display unit that displays text or an image, wherein the control unit displays a button on the display unit and increases the output of the fan when the button is pressed.

22. The image forming apparatus according to claim 21, wherein the control unit displays the button on the display unit when a first mode is switched to a second mode.

23. The image forming apparatus according to claim 21, further comprising:

a temperature sensor that detects a temperature of the heating unit, wherein the control unit decreases the output of the fan when the temperature of the heating unit reaches a predetermined temperature.

24. The image forming apparatus according to claim 21, further comprising:

a memory that stores a set time, wherein the control unit decreases the output of the fan when a preset time is reached.

25. The image forming apparatus according to claim 21, wherein the control unit displays the button on the display unit when the fixing temperatures of toners are different from each other.

26. The image forming apparatus according to claim 21, wherein the control unit displays the button on the display unit when the types of the recording media are different from each other.

27. The image forming apparatus according to claim 22, wherein the first mode is a decolorizing mode in which images are decolorized from the recording medium, and the second mode is a decolorable toner mode in which images are fixed on the recording medium with a decolorable toner.

28. The image forming apparatus according to claim 22, wherein the first mode is a non-decolorable toner mode in which images are formed with a non-decolorable toner, and the second mode is a decolorable toner mode in which images are formed with a decolorable toner.

29. The image forming apparatus according to claim 22, wherein the first mode is a monochrome toner mode in which images are formed with a non-decolorable black monochrome toner, and the second mode is a colorable toner mode in which images are formed with a non-decolorable monochrome toner and a colorable toner.

30. The image forming apparatus according to claim 22, wherein the first mode is a colorable toner mode in which images are formed with a non-decolorable monochrome toner and the colorable toner, and the second mode is a monochrome toner mode in which images are formed with a non-decolorable black monochrome toner.

31. The method according to claim 11, wherein the image forming apparatus further comprises a display unit that displays text or an image, and a button is displayed on the display unit and the quantity of wind guided to the heating unit is increased when the button is pressed.

32. The method according to claim 31, wherein the button is displayed on the display unit when a first mode is switched to a second mode.

33. The method according to claim 31, wherein the image forming apparatus further comprises a temperature sensor that detects the temperature of the heating unit, and the quantity of wind guided to the heating unit is decreased when the temperature of the heating unit reaches a predetermined temperature.

34. The method according to claim 31, wherein the image forming apparatus further comprises a memory that stores a set time, wherein the quantity of wind guided to the heating unit is decreased when a preset time is reached.

35. The method according to claim 31, wherein the button is displayed on the display unit when the fixing temperatures of toners are different from each other.

36. The method according to claim 31, wherein the button is displayed on the display unit when the types of the recording media are different from each other.

37. The method according to claim 32, wherein the first mode is a decolorizing mode in which images are decolorized from the recording medium, and the second mode is a decolorable toner mode in which images are fixed on the recording medium with a decolorable toner.

38. The method according to claim 32, wherein the first mode is a non-decolorable toner mode in which images are formed with a non-decolorable toner, and the second mode is a decolorable toner mode in which images are formed with a decolorable toner.

39. The method according to claim 32, wherein the first mode is a monochrome toner mode in which images are formed with a non-decolorable black monochrome toner, and the second mode is a colorable toner mode in which images are formed with a non-decolorable monochrome toner and a colorable toner.

40. The method according to claim 32, wherein the first mode is a colorable toner mode in which images are formed with a non-decolorable monochrome toner and the colorable toner, and the second mode is a monochrome toner mode in which images are formed with a non-decolorable black monochrome toner.

* * * * *